United States Patent [19]

Sagiyama et al.

[11] Patent Number: 4,904,545

[45] Date of Patent: Feb. 27, 1990

[54] COMPOSITE ELECTROPLATED STEEL SHEET

[75] Inventors: Masaru Sagiyama; Yukimitsu Shiohara, both of Tokyo, Japan

[73] Assignee: NKK Corporation, Tokyo, Japan

[21] Appl. No.: 215,032

[22] Filed: Jul. 5, 1988

[30] Foreign Application Priority Data

Jul. 10, 1987 [JP] Japan ..... 62-173684

[51] Int. Cl.[4] ..... B32B 15/18

[52] U.S. Cl. ..... 428/659; 428/614; 428/935

[58] Field of Search ..... 428/614, 659, 935; 204/44.2, 55.1

[56] References Cited

U.S. PATENT DOCUMENTS

| | | | |
|---|---|---|---|
| 3,791,801 | 2/1974 | Ariga et al. | 428/659 |
| 4,524,111 | 6/1985 | Oka et al. | 428/659 |
| 4,650,724 | 3/1987 | Umino et al. | 428/935 |

FOREIGN PATENT DOCUMENTS

| | | | |
|---|---|---|---|
| 174019 | 3/1986 | European Pat. Off. | 428/659 |
| 30649 | 10/1979 | Japan . | |
| 141898 | 7/1985 | Japan | 204/44.2 |
| 38480 | 8/1985 | Japan . | |
| 6758 | 2/1987 | Japan . | |
| 6760 | 2/1987 | Japan . | |

*Primary Examiner*—Robert McDowell

*Attorney, Agent, or Firm*—Frishauf, Holtz, Goodman & Woodward

[57] ABSTRACT

A composite electroplated steel sheet comprises Zn being a matrix metal of a plating layer; and codeposited particles of a plating layer of at least one selected from the group consisting of $Mg_2Si_3O_8$, $CaSiO_3$ and $BaTiO_3$. A composite electroplated steel sheet comprises Zn alloy containing at least one selected from the group consisting of Fe, Co, Ni, Mn, Cr and Ti being a matrix metal of a plating layer; and codeposited particles of a plating layer comprising at least one selected from the group consisting of $Mg_2Si_3O_8$, $CaSiO_3$ and $BaTiO_3$. The codeposited particles are contained within the range of from 0.1 to 5.0 wt.% in a plating layer.

38 Claims, No Drawings

COMPOSITE ELECTROPLATED STEEL SHEET

BACKGROUND OF THE INVENTION

1. Field of the Invention

The present invention relates to a zinciferous composite electroplated steel sheet, and more particularly to a high corrosion resistance zinciferous composite electroplated steel sheet containing codeposited particles in a zinc plating layer.

2. Description of the Prior Arts

Two prior art methods of improving corrosion resistance of zinc plated steel sheet are as follows;

(a) A method of thickening a plating layer;

(b) A method of improving the corrosion resistance of a plating layer by converting the plating layer to an alloy or composite layer.

Out of the two methods, the method (a) has disadvantages from a viewpoint of a resource-saving and an energy-saving in a manufacturing process and further from a viewpoint of the quality of products such as a weldability, a press workability and the like. Hitherto, the method (b) has mainly been studied and developed.

In a process belonging to the method (b), zinc alloy electroplating has been widely studied and developed because alloy plating layers of zinc with other various sorts of metals can be easily effected by means of the electroplating. As a result, in alloy plating such as Zn-Co-Cr, Zn-Fe, Zn-Ni, Zn-Mn and the like, alloying elements repress the activity of zinc. This characteristics indicates improvement in a high corrosion resistance of a plating layer can be attained. Therefore, the alloy plating is already been put into practice. Besides the above zinc alloy plating, composite electroplating method is being studied wherein the particles contained in plating solutions are codeposited into plated metals mainly composed of zinc.

A composite plated steel sheet in which aluminium disperses and a method of manufacturing the same are disclosed, for example, in a Japanese Examined Patent Publication No. 30649/79. Aluminium is dispersed in electrolytically deposited zinc layers of a composite electroplated steel sheet within its range of from 1.5 to 70 wt.%. The composite electroplated steel sheet is manufactured by adding aluminium powder to a zinc plating solution to form a composite plating solution suspending the aluminium powder in the composite plating solution and an electrolizing the solution while the solution is stirred.

It is shown in a Japanese Examined Patent Publication No. 38480/85 that at least one of particles of silica sol, titanium oxide sol and zirconia sol of 100 nm or less in size which has been treated to be charged positively are used, that steel is made cathodic in acid zinc plating bath of pH 4 or less to which 1 to 200 g/l of said particles are added, and that the acid zinc plating bath is electrolized to codeposit zinc and said particles on the surface of the steel.

In a Japanese Examined Patent Publication No. 6758/87 a high corrosion resistance zinc-alumina composite electroplated steel sheet is disclosed. Its electroplated zinc layers contain 0.01 to 3.0 wt.% of alumina sol, calculated in terms of $Al_2O_3$, which is soluble in more than 0.1N of a hydrochloric acid in concentration.

It is shown in a Japanese Examined Patent Publication No. 6760/87 that at least one of $Ni^{2+}$, $Fe^{2+}$ and $Co^{2+}$ are adsorbed by at least one of oxide particles such as $SiO_2$, $TiO_2$, $ZrO_2$, $Nb_2O_5$ and $Ta_2O_5$ to let the oxide particles be charged positively for the purpose of electroplating a steel sheet by dispersing stably these particles in a zinc plating bath to form a composite plating bath.

In the mentioned prior art methods, however, it is not easy to codeposit the particles dispersing in a plating bath together with zinc. Therefore, it is insufficient to optimize a composition of a composite plating layer.

SUMMARY OF THE INVENTION

It is an object of the present invention to provide a composite electroplated steel sheet being excellent in corrosion resistance.

To accomplish the object, in accordance with the present invention, a composite electroplated steel sheet is provided, which comprises:

Zn being a matrix metal of a plating layer; and codeposited particles of a plating layer having at least one selected from the group consisting of $Mg_2Si_3O_8$, $CaSiO_3$ and $BaTiO_3$.

Further, in accordance with the present invention, a composite electroplated steel sheet; comprises:

zinc alloy being a matrix metal of a plating layer having Zn and at least one selected from the group consisting of a group of Fe, Co, Ni, Mn, Cr and Ti;

codeposited particles of a plating layer having at least one selected from a group of $Mg_2Si_3O_8$, $CaSiO_3$ and $BaTiO_3$.

The object and other objects and advantages of the present invention will become apparent from the detailed description to follow.

DESCRIPTION OF THE PREFERRED EMBODIMENT

In the present invention, zinc is a matrix metal of a plating layer and at least one selected from the group consisting of $Mg_2Si_3O_8$, $CaSiO_3$ and $BaTiO_3$ is codeposited particles of a plating layer. Said codeposited particles is contained preferably within the range of 0.1 to 5.0 wt.% in the plating layer. If the content of the codeposited particles is less than 0.1 wt.%, an improvement in a corrosion resistance is not sufficient. If the content of the codeposited particles is more than 5.0 wt.%, an adhesion of the plating layer to a steel sheet decreases. The content of the codeposited particles ranges more preferrably from 1.0 to 4.0 wt.%. The codeposited particles exist as particles in a plating solution. Large size codeposited particles are apt to deposit and electrodeposited layers formed by the large size codeposited particles have a nonuniform composition. Therefore, small size particles are preferable. Namely, 100 μm or less in size are preferable.

As mentioned above, zinc can be singly used as the matrix metal of the plating layer. Zinc alloy including at least one selected from the group consisting of Co, Ni, Mn, Cr and Ti can also be used as the matrix metal of the plating layer. If such alloy is used in the form of the matrix metal of the plating layer, the activity of zinc is repressed and the corrosion resistance thereof becomes better than in the case of zinc being employed singly. It is preferable that at least one selected from the group consisting of Fe, Co, Ni, Mn, Cr and Ti is contained in the range of 0.1 to 30.0 wt.%, as alloying elements, in the plating layer. If the content of those elements is less than 0.1 wt.%, the effectiveness in repressing the activity of zinc is not sufficient. If the content is more than 30.0 wt.%, the zinc sacrificing corrosion protection ability decreases. This leads to a deterioration of a corrosion resistance. Even in case a zinc alloy is the matrix metal of the plating layer, it is preferably that said codeposited particles are contained in the range of 0.1 to 5.0 wt.% in the plating layer. If the content of the codeposited particles is less than 0.1 wt.%, the effectiveness in increasing a corrosion resistance is not sufficient. If the content of the codeposited particles is more than 5.0 wt.%, the adhesion of the plating layer decreases. 1.0 to 4.0 wt.% is more preferable. As in the case of zinc being a matrix metal of a plating layer, small size codeposited particles are preferable. 100 μm or less than in particle size is preferable.

A composite electroplating can be carried out by using a plating solution in which the codeposited particles are dispersed as well as an ordinary electroplating. A solution containing Zn ion or containing $Zn^{+2}$ ion and an alloy element ion added thereto can be used as a plating solution. The solution is at least one selected from the group consisting of sulfuric acid bath, chloride bath, sulfamic acid bath, borofluoride bath and mixture of these bath.

A percentage of the codeposited particles in a composite plating layer, i.e. a codeposition ratio is greatly affected by a composition of the plating solution. That is to say, when the composite plating solution, to which at least one selected from the group consisting of $Mg_2Si_3O_8$, $CaSiO_3$ and $BaTiO_3$ is added simply to zinc solution, is used, the codeposition ratio decreases. However, if $Fe^{2+}$ ion, $Co^{2+}$ ion, $Ni^{2+}$ ion or $Mn^{2+}$ ion exists in the plating solution, the codeposition ratio increases because these ions are adsorbed to the surface of particles and the particles are charged positively and apt to deposit on a cathode. In this case, because these metallic ions deposit simultaneously, the composite plating layer having an alloy matrix is formed. In the meantime, when $Al^{3+}$ ion is added to the composite plating solution, $Al^{3+}$ ion promotes a deposition of the codeposited particles by letting the surface of the particles be charged positively. But, the deposition potential of $Al^{3+}$ ion is exceedingly base. Therefore, $Al^{3+}$ ion does not electrodeposit and the composite plating layer having a zinc matrix can be formed easily.

EXAMPLE

A composite electroplated steel sheet having a plating layer composed of a zinc matrix metal, was manufactured on the basis as shown below to investigate corrosion resistance of the steel sheet. The composition of the baths (the standared bath);

| | |
|---|---|
| $ZnSO_4.7H_2O$ | 250 g/l |
| $Na_2SO_4$ | 30 g/l |
| $CH_3COONa.3H_2O$ | 20 g/l |
| $Al_2(SO_4)_3.14H_2O$ | from 10 to 200 g/l |
| Codeposited particles | from 50 to 500 g/l |

The corrosion resistance was evaluated by means of the hours of neutral salt spray before occurrence of red rust according to JIS Z 2371. A composition of the plating layers of each sample material and the results of the corrosion resistance test are shown in Table 1.

The above plating bath was of pH of from 1 to 4, at 50° C. A pretreated cold rolled steel sheet was plated under the condition of an electric current density of from 10 to 70 A/dm$^2$ and stirring the solution, to form a 20 g/mm$^2$ of layer in thickness thereon.

In Control-1 which does not contain codeposited particles having at least one selected from the group of $Mg_2Si_2O_8$ $CaSiO_3$ and $BaTiO_3$ in a plating layer, and in controls-2 to 4 which contain 0.01 wt.% codeposited particles the hours before the occurrence of red rust was 24 hours. On the other hand, in Example 1 to 9 of the present invention which contain codeposited particles consisting of at least one selected from the group consisting of $Mg_3Si_3O_8$, $CaSiO_3$ and $BaTiO_3$, the hours before the occurrence of red rust was improved to the extent that it marked 36, 48 and 60 hours.

A composite plating layer having a zinc alloy matrix containing at least one selected from the group consisting of Fe, Co, Ni, Cr and Ti was formed by adding a single metallic salt or a plurality of metallic salts to the mentioned standard bath in compliance with alloying elements. $FeSO_4.7H_2O$, $NiSO_4$ $6H_2O$, $CoSO_4.7GH_2O$, $CrO_3$ and titanium sulfate were used as metallic salts. The plating bath was of pH of from 1 to 4 and at 50° C. A pretreated cold rolled steel sheet was plated, under the condition of an electric current density of from 10 to 70 A/dm$^2$ and stirring the solution, to form 20 g/mm$^2$ of layers in thickness thereon. The composition of the plated layers of each of the sample materials and the results of the corrosion resistance test are shown in Tables 2 to 10.

Table 2 shows a case where a matrix metal in a plating layer is of Zn-Ni alloy. Control-5 shows a case where a composition of a plating layer is 88 wt.% of Zn and 12 wt.% of Ni and the plating layer does not contain codeposited particles. Examples-10 to 11 show a case where a composition of a plating layer is 85 wt.% of Zn, 12 wt.% of Ni and 3 wt.% of codeposited particles consisting of at least one selected from the group consisting of $Mg_2Si_3O_8$, $CaSiO_3$ and $BaTiO_3$. Control-6 shows a case where a composition of a plating layer is 64 wt.% of Zn 35 wt.% of Ni and 1 wt.% of $Mg_2Si_3O_8$. Examples-10 to 11 whose plating layer contained 3 wt.% of codeposited particles, it took a long time before the red rust occurred, compared with control-5 whose plating layer did not contain any codeposited particles. In Control-6 whose plating layer contained more than 30 wt.% of Ni, the red rust occurred in a short time.

Table 3 shows a case where a matrix metal of a plating layer is Zn-Co alloy. Similarly to the case with Zn-Ni alloy, in the case of the Control-7 whose plating layers did not contain codeposited particles and in the control-8 whose plating layer contained more than 30 wt.% of Co, the red rust occurred in a shorter time than in the case of Examples-12 to 13 whose plating layers contained 7 wt.% of Co and 3 wt.% of codeposited particles having at least one selected from the group consisting of $Mg_2Si_2O_8$, $CaSiO_3$ and $BaTiO_3$.

Table 4 shows a case where a matrix metal of a plating layer is Zn-Fe alloy. In Examples-14 to 15 whose plating layers contained 10 wt.% of Fe and 3 wt.% of codeposited paticles having at least one selected from the group consisting of $Mg_2Si_3O_8$, $CaSiO_3$ and $BaTiO_3$, it took a long time before the red rust occurred, compared with Control-10 whose plating layer contained more than 30 wt.% of Fe.

Tables 5, 6, 7, 8, 9 and 10 show the cases where matrix metals of plating layers, each, are Zn-Cr alloy, Zn-Ti alloy, Zn-Ni-Cr alloy, Zn-Ni-Ti alloy, Zn-Co-Ti alloy and Zn-Fe-Ti alloy. In any case of Examples whose plating layers contained 3 wt.% of codeposited particles having at least one selected from the group consisting of $Mg_2Si_3O_8$, $CaSiO_3$ and $BaTiO_3$, it took a long time before the red rust occurred, compared with those Controls whose plating layers did not contain codeposited particles.

A composite plated steel sheet having a plating layer composed of a alloy matrix containing Mn, was manufactured on the basis shown below to inspect its corrosion resistance.

| | |
|---|---|
| $ZnSO_4.7H_2O$ | 70 g/l |
| $MnSO_4.H_2O$ | 40 g/l |
| $Na_3C_6H_5O_7.2H_2O$ | 180 g/l |
| $Al_2(SO_4)_3.14H_2O$ | 30 g/l |
| Codeposited particles | from 50 to 500 g/l |

A single metal salt or a plurality of metallic salts, as alloy elements besides Mn, were added to the mentioned standard bath. The mentioned plating bath was of pH of from 3 to 6 and at 50° C. A pretreated cold rolled steel sheet was plated, under the condition of an electric current density of from 10 to 50 A/dm$^2$, and stirring and plating solution, to form 20 g/mm$^2$ of layers.

Tables 11 to 12 show the cases where matrix metals of plating layers are Zn-Mn alloy and Zn-Mn-Ti alloy. In the Examples whose plating layers contain 3 wt.% of codeposited particles comprising at least one selected from the group consisting of $Mg_2Si_3O_8$, $CaSiO_3$ and $BaTiO_3$, it took a long time before the red rust occurred, compared with the Controls whose plating layers did not contain codeposited particles.

TABLE 1

| | Composition of plating layer (wt. %) | | | | Occurrence of red rust |
|---|---|---|---|---|---|
| | Zn | $Mg_2Si_3O_8$ | $CaSiO_3$ | $BaTiO_3$ | (Hr) |
| Control-1 | 100 | — | — | — | 24 |
| Control-2 | 99.99 | 0.01 | — | — | 24 |
| Control-3 | 99.99 | — | 0.01 | — | 24 |
| Control-4 | 99.99 | — | — | 0.01 | 24 |
| Example-1 | 99 | 1 | — | — | 36 |
| Example-2 | 99 | — | 1 | — | 36 |
| Example-3 | 99 | — | — | 1 | 36 |
| Example-4 | 97 | 3 | — | — | 48 |
| Example-5 | 97 | — | 3 | — | 48 |
| Example-6 | 97 | — | — | 3 | 48 |
| Example-7 | 96 | 2 | 1 | 1 | 60 |
| Example-8 | 96 | 1 | 2 | 1 | 60 |
| Example-9 | 96 | 1 | 1 | 2 | 60 |

TABLE 2

| | Composition of plating layer (wt. %) | | | | | Occurrence of red rust |
|---|---|---|---|---|---|---|
| | Zn | Ni | $Mg_2Si_3O_8$ | $CaSiO_3$ | $BaTiO_3$ | (Hr) |
| Control-5 | 88 | 12 | — | — | — | 240 |
| Example-10 | 85 | 12 | 3 | — | — | 336 |
| Example-11 | 85 | 12 | 1 | 1 | 1 | 336 |
| Control-6 | 64 | 35 | 1 | — | — | 24 |

TABLE 3

| | Composition of plating layer (wt. %) | | | | | Occurrence of red rust |
|---|---|---|---|---|---|---|
| | Zn | Co | $Mg_2Si_3O_8$ | $CaSiO_3$ | $BaTiO_3$ | (Hr) |
| Control-7 | 93 | 7 | — | — | — | 120 |
| Example-12 | 90 | 7 | 3 | — | — | 168 |
| Example-13 | 90 | 7 | 1 | 1 | 1 | 168 |
| Control-8 | 64 | 35 | 1 | — | — | 24 |

TABLE 4

| | Composition of plating layer (wt. %) | | | | | Occurrence of red rust |
|---|---|---|---|---|---|---|
| | Zn | Fe | $Mg_2Si_3O_8$ | $CaSiO_3$ | $BaTiO_3$ | (Hr) |
| Control-9 | 90 | 10 | — | — | — | 12 |
| Example-14 | 87 | 10 | 3 | — | — | 24 |
| Example-15 | 87 | 10 | 1 | 1 | 1 | 24 |
| Control-10 | 49 | 50 | 1 | — | — | 12 or less |

TABLE 5

| | Composition of plating layer (wt. %) | | | | | Occurrence of red rust (Hr) |
|---|---|---|---|---|---|---|
| | Zn | Cr | $Mg_2Si_3O_8$ | $CaSiO_3$ | $BaTiO_3$ | |
| Control-11 | 99.9 | 0.1 | — | — | — | 72 |
| Example-16 | 96.9 | 0.1 | 3 | — | — | 116 |
| Example-17 | 96.9 | 0.1 | 1 | 1 | 1 | 116 |

TABLE 6

| | Composition of plating layer (wt. %) | | | | | Occurrence of red rust |
|---|---|---|---|---|---|---|
| | Zn | Ti | $Mg_2Si_3O_8$ | $CaSiO_3$ | $BaTiO_3$ | (Hr) |
| Control-12 | 98 | 2 | — | — | — | 168 |
| Example-18 | 95 | 2 | 3 | — | — | 240 |
| Example-19 | 95 | 2 | 1 | 1 | 1 | 240 |

TABLE 7

| | Composition of plating layer (wt. %) | | | | Occurrence of red rust |
|---|---|---|---|---|---|
| | Zn | Ni | Cr | $Mg_2Si_3O_8$ | (Hr) |
| Control-13 | 87.9 | 12 | 0.1 | — | 480 |
| Example-20 | 84.9 | 12 | 0.1 | 3 | 576 |

TABLE 8

| | Composition of plating layer (wt. %) | | | | Occurrence of red rust |
|---|---|---|---|---|---|
| | Zn | Ni | Ti | $CaSiO_3$ | (Hr) |
| Control-14 | 86 | 12 | 2 | — | 528 |
| Example-21 | 83 | 12 | 2 | 3 | 624 |

TABLE 9

| | Composition of plating layer (wt. %) | | | | Occurrence of red rust |
|---|---|---|---|---|---|
| | Zn | Co | Ti | $BaTiO_3$ | (Hr) |
| Control-15 | 91 | 7 | 2 | — | 360 |
| Example-22 | 88 | 7 | 2 | 3 | 456 |

TABLE 10

| | Composition of plating layers (wt. %) | | | | Occurrence of red rust |
|---|---|---|---|---|---|
| | Zn | Fe | Ti | $Mg_2Si_3O_8$ | (Hr) |
| Control-16 | 88 | 10 | 2 | — | 168 |
| Example-23 | 85 | 10 | 2 | 3 | 240 |

TABLE 11

| | Composition of plating layer (wt. %) | | | | | Occurrence of red rust (Hr) |
|---|---|---|---|---|---|---|
| | Zn | Mn | $Mg_2Si_3O_8$ | $CaSiO_3$ | $BaTiO_3$ | |
| Control-17 | 75 | 25 | — | — | — | 96 |
| Example-24 | 72 | 25 | 3 | — | — | 144 |
| Example-25 | 72 | 25 | 1 | 1 | 1 | 144 |

TABLE 12

| | Composition of plating layer (wt. %) | | | | Occurrence of red rust |
|---|---|---|---|---|---|
| | Zn | Mn | Ti | $Mg_2Si_3O_8$ | (Hr) |
| Control-18 | 73 | 25 | 2 | — | 240 |
| Example-26 | 70 | 25 | 2 | 3 | 336 |

What is claimed is:

1. A composite electroplated steel sheet, comprising an electroplated Zn layer on a steel sheet, said Zn layer comprising a Zn matrix containing codeposited particles in said matrix, said codeposited particles comprising at least one selected from the group consisting of $Mg_2Si_3O_8$, $CaSiO_3$ and $BaTiO_3$ in an amount of 0.1 to 5.0 wt.% of said Zn layer.

2. The composite electroplated steel sheet of claim 1, wherein said codeposited particles are in an amount of 1 to 4 wt.% of said Zn layer.

3. The composite electroplated steel sheet of claim 1, wherein said codeposited particles are in an amount of 3 to 4 wt.% of said Zn layer.

4. The composite electroplated steel sheet of claim 1, wherein said codeposited particles comprises particles of 100 μm or less in size.

5. The composite electroplated steel sheet of claim 1, wherein said codeposited particles comprise particles of $Mg_2Si_3O_8$ of 100 μm or less in size.

6. The composite electroplated steel sheet of claim 5, which contains 3 to 4 wt.% of said codeposited particles in said Zn layer.

7. The composite electroplated steel sheet of claim 1, wherein said codeposited particles comprise particles of $CaSiO_3$ of 100 μm or less in size.

8. The composite electroplated steel sheet of claim 7, which contains 3 to 4 wt.% of said codeposited particles in said Zn layer.

9. The composite electroplated steel sheet of claim 1, wherein said codeposited particles comprise particles of $BaTiO_3$ of 100 μm or less in size.

10. The composite electroplated steel sheet of claim 9, which contains 3 to 4 wt.% of said codeposited particles in said Zn layer.

11. A composite electroplated steel sheet comprising an electroplated Zn alloy layer on a steel sheet, said Zn alloy layer comprising a Zn alloy matrix, said Zn alloy matrix comprising Zn and at least one element selected from the group consisting of Fe, Co, Mn, Ni, Cr and Ti, said at least one element being in an amount of 0.1 to 30.0 wt.% of said Zn alloy layer; and, said Zn alloy matrix containing codeposited particles in said matrix, said codeposited particles comprising at least one selected from the group consisting of $Mg_2Si_3O_8$, $CaSiO_3$ and $BaTiO_3$in an amount of 0.1 to 5.0 wt.% of said Zn alloy layer.

12. The composite electroplated steel sheet of claim 11, wherein codeposited particles comprise particles of $Mg_2Si_3O_8$ of 100 μm or less in size.

13. The composite electroplated steel sheet of claim 11, wherein said codeposited particles comprise particles of $CaSiO_3$ of 100 μm or less in size.

14. The composite electroplated steel sheet of claim 11, wherein said codeposited particles comprise particles of $BaTiO_3$ of 100 μm or less in size.

15. The composite electroplated steel sheet of claim 11, wherein said codeposited particles are of 1 to 4 wt.% of said Zn alloy layer.

16. The composite electroplated steel sheet of claim 15, wherein said codeposited particles are of 3 to 4 wt.% of said Zn alloy layer.

17. The composite electroplated steel sheet of claim 11, wherein said Zn alloy is Zn-Ni.

18. The composite electroplated steel sheet of claim 17, wherein said codeposited particles comprise particles 100 μm or less in size in an amount of 3 to 4 wt.% of said Zn alloy layer.

19. The composite electroplated steel sheet of claim 11, wherein said Zn alloy is Zn-Co.

20. The composite electroplated steel sheet of claim 19, wherein said codeposited particles comprise particles 100 μm or less in size in an amount of 3 to 4 wt.% of said Zn alloy layer.

21. The composite electroplated steel sheet of claim 11, wherein said Zn alloy is Zn-Fe.

22. The composite electroplated steel sheet of claim 21, wherein said codeposited particles comprise particles 100 μm or less in size in an amount of 3 to 4 wt.% of said Zn alloy layer.

23. The composite electroplated steel sheet of claim 11, wherein said Zn alloy is Zn-Cr.

24. The composite electroplated steel sheet of claim 23, wherein said codeposited particles comprise particles 100 μm or less in size in an amount of 3 to 4 wt.% of said Zn alloy layer.

25. The composite electroplated steel sheet of claim 11, wherein said Zn alloy is Zn-Ti.

26. The composite electroplated steel sheet of claim 25, wherein said codeposited particles comprise particles 100 μm or less in size in an amount of 3 to 4 wt.% of said Zn alloy layer.

27. The composite electroplated steel sheet of claim 11, wherein said Zn alloy is Zn-Ni-Cr.

28. The composite electroplated steel sheet of claim 27, wherein said codeposited particles comprise particles 100 μm or less in size in an amount of 3 to 4 wt.% of said Zn alloy layer.

29. The composite electroplated steel sheet of claim 11, wherein said Zn alloy is Zn-Ni-Ti.

30. The composite electroplated steel sheet of claim 29, wherein said codeposited particles comprise particles 100 μm or less in size in an amount of 3 to 4 wt.% of said Zn alloy layer.

31. The composite electroplated steel sheet of claim 11, wherein said Zn alloy is Zn-Co-Ti.

32. The composite electroplated steel sheet of claim 31, wherein said codeposited particles comprise particles 100 μm or less in size in an amount of 3 to 4 wt.% of said Zn alloy layer.

33. The composite electroplated steel sheet of claim 11, wherein said Zn alloy is Zn-Fe-Ti.

34. The composite electroplated steel sheet of claim 33, wherein said codeposited particles comprise particles 100 μm or less in size in an amount of 3 to 4 wt.% of said Zn alloy layer.

35. The composite electroplated steel sheet of claim 11, wherein said Zn alloy is Zn-Mn.

36. The composite electroplated steel sheet of claim 35, wherein said codeposited particles comprise particles 100 μm or less in size in an amount of 3 to 4 wt.% of said Zn alloy layer.

37. The composite electroplated steel sheet of claim 11, wherein said Zn alloy is Zn-Mn-Ti.

38. The composite electroplated steel sheet of claim 37, wherein said codeposited particles comprise particles 100 μm or less in size in an amount of 3 to 4 wt.% of said Zn alloy layer.

* * * * *